US010850297B1

(12) United States Patent
Laudon

(10) Patent No.: US 10,850,297 B1
(45) Date of Patent: Dec. 1, 2020

(54) WIDE-BODY ROLLER PAINT SYSTEM

(71) Applicant: James Laudon, Clearwater, FL (US)

(72) Inventor: James Laudon, Clearwater, FL (US)

( * ) Notice: Subject to any disclaimer, the term of this patent is extended or adjusted under 35 U.S.C. 154(b) by 0 days.

(21) Appl. No.: 16/388,790

(22) Filed: Apr. 18, 2019

Related U.S. Application Data

(60) Provisional application No. 62/804,008, filed on Feb. 11, 2019.

(51) Int. Cl.
*B05C 1/08* (2006.01)

(52) U.S. Cl.
CPC ..... *B05C 1/0813* (2013.01)

(58) Field of Classification Search
CPC ..... B44D 3/12; B44D 3/126; B44D 3/128; A45F 5/10; B25G 1/10
See application file for complete search history.

(56) References Cited

U.S. PATENT DOCUMENTS 3,493,988 A * 2/1970 Tidwell ..... B44D 3/126 15/257.06
4,824,156 A * 4/1989 Greene ..... A45F 5/10 294/137
4,928,843 A * 5/1990 Gunderson ..... B44D 3/126 15/257.06
D471,017 S * 3/2003 Cheung ..... D28/20
7,703,631 B2 * 4/2010 Chafe ..... B44D 3/12 15/257.06

* cited by examiner

*Primary Examiner* — Andrew T Kirsch

(57) ABSTRACT

A bucket has a generally cylindrical configuration with an open top, a closed bottom, and a side wall extending there between. The bucket has an axis. The side wall has a first major section extending between the open top and the closed bottom. The side wall has a second major section extending between the open top and the closed bottom. The first and second major sections are separated to circumferentially create a first opening and a second opening. The first and second major sections are spaced from the axis by primary distances. The side wall has a first minor section and a second minor section. The first and second minor sections are located adjacent to the first and second openings respectively. The first and second minor sections are spaced from the axis by secondary distances greater than the primary distances.

1 Claim, 4 Drawing Sheets

FIG. 1
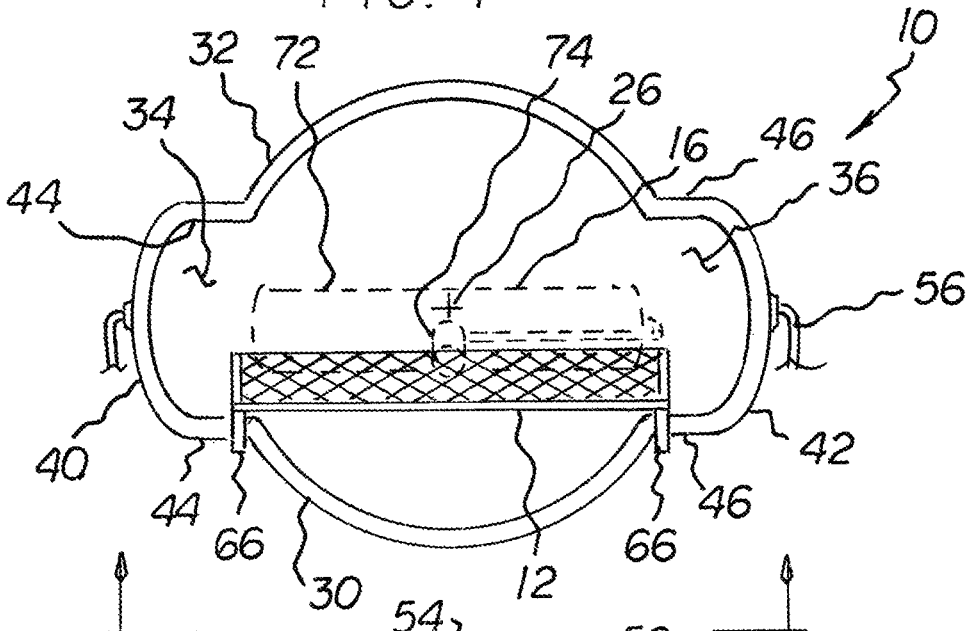
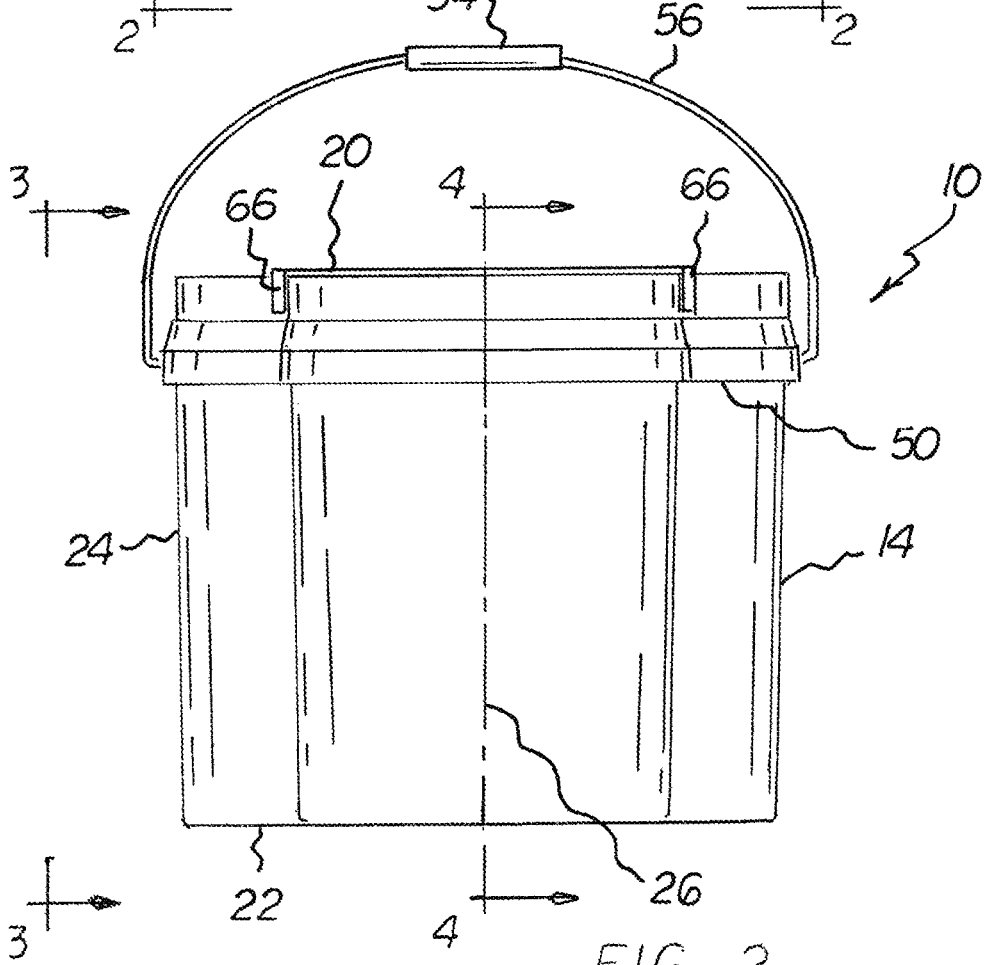
FIG. 2

FIG. 7
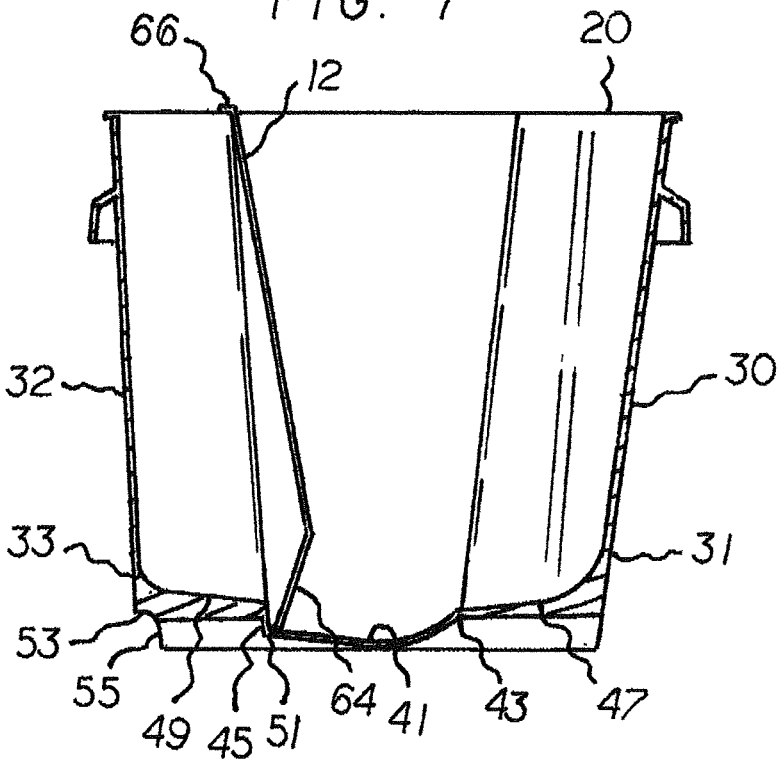
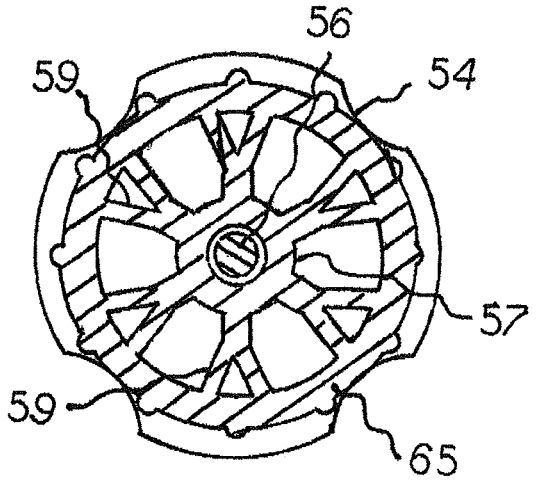
FIG. 8

WIDE-BODY ROLLER PAINT SYSTEM

RELATED APPLICATION

This non-provisional application is based upon and claims priority of Provisional Application No. 62/804,008 filed Feb. 11, 2019, the subject matter of which is incorporated herein by reference.

BACKGROUND OF THE INVENTION

Field of the Invention

The present invention relates to a wide-body roller painting system and more particularly pertains to fixedly positioning a roller screen in a bucket and for abating interference contact between a roller and the bucket. The positioning and abating are done in a safe, convenient, and economical manner.

Description of the Prior Art

The use of paint buckets and roller painting systems of known designs and configurations is known in the prior art. More specifically, paint buckets and roller painting systems of known designs and configurations previously devised and utilized for the purpose of painting using a roller screen and a paint roller are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a wide-body roller painting system for fixedly positioning a roller screen in a bucket and for abating interference contact between a roller and the bucket in a safe, convenient, and economical manner.

In this respect, the wide-body roller painting system according to the present invention substantially departs from the conventional concepts and designs of the prior art, and in doing so provides an apparatus primarily developed for the purpose of fixedly positioning a roller screen or grid within a bucket and for abating interference contact between a roller and the bucket. The positioning and the abating are done in a safe, convenient, and economical manner.

Therefore, it can be appreciated that there exists a continuing need for a new and improved roller painting system which can be used for fixedly positioning a roller screen in a bucket and for abating interference contact between a roller and the bucket in a safe, convenient, and economical manner. In this regard, the present invention substantially fulfills this need.

SUMMARY OF THE INVENTION

In view of the disadvantages inherent in the known types of roller painting systems of known designs and configurations now present in the prior art, the present invention provides an improved wide-body roller painting system. As such, the general purpose of the present invention, which will be described subsequently in greater detail, is to provide a new and improved wide-body roller painting system and method which has all the advantages of the prior art and none of the disadvantages.

To attain this, from a broad perspective, the present invention provides a bucket. The bucket has a generally cylindrical configuration with an open top, a closed bottom, and a side wall extending there between. The bucket has a central axis. The side wall has a first major section extending between the open top and the closed bottom. The side wall has a second major section extending between the open top and the closed bottom. The first and second major sections are separated to circumferentially create a first opening and a second opening. The first and second major sections are spaced from the axis by primary distances. The side wall has a first minor section and a second minor section. The first minor section is located adjacent to the first opening. The second minor section is located adjacent to the second opening. The first and second minor sections are spaced from the axis by secondary distances greater than the primary distances. The closed bottom is configured with a U-shaped trough extending between the minor sections.

There has thus been outlined, rather broadly, the more important features of the invention in order that the detailed description thereof that follows may be better understood and in order that the present contribution to the art may be appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved wide-body roller painting system which has all the advantages of the prior roller painting systems of known designs and configurations and none of the disadvantages.

It is another object of the present invention to provide a new and improved wide-body roller painting system which may be easily and efficiently manufactured and marketed.

It is a further object of the present invention to provide a new and improved wide-body roller painting system which is of durable and reliable constructions.

An even further object of the present invention is to provide a new and improved wide-body roller painting system which is susceptible of a low cost of manufacture with regard to both materials and labor, and which accordingly is then susceptible of low prices of sale to the consuming public, thereby making such wide-body roller painting system economically available.

Lastly, it is an object of the present invention to provide a wide-body roller painting system for fixedly positioning a roller screen in a bucket and for abating interference contact between a roller and the bucket. The positioning and abating are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a plan view of a roller paint system constructed in accordance with the principles of the present invention.

FIG. 2 is a rear elevational view taken along line 2-2 of FIG. 1.

FIG. 7 is a cross sectional view taken along line 7-7 of FIG. 5.

FIG. 8 is a cross sectional view taken along line 8-8 of FIG. 5.

The same reference numerals refer to the same parts throughout the various Figures.

DESCRIPTION OF THE PREFERRED EMBODIMENT

Figure 3:
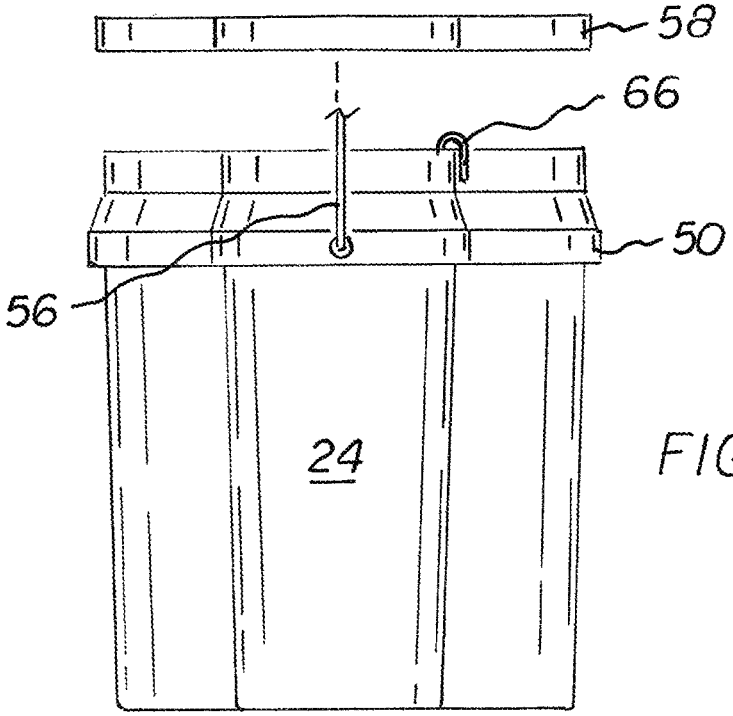
FIG. 3 is a side elevational view taken along line 3-3 of FIG. 2.
Figure 4:
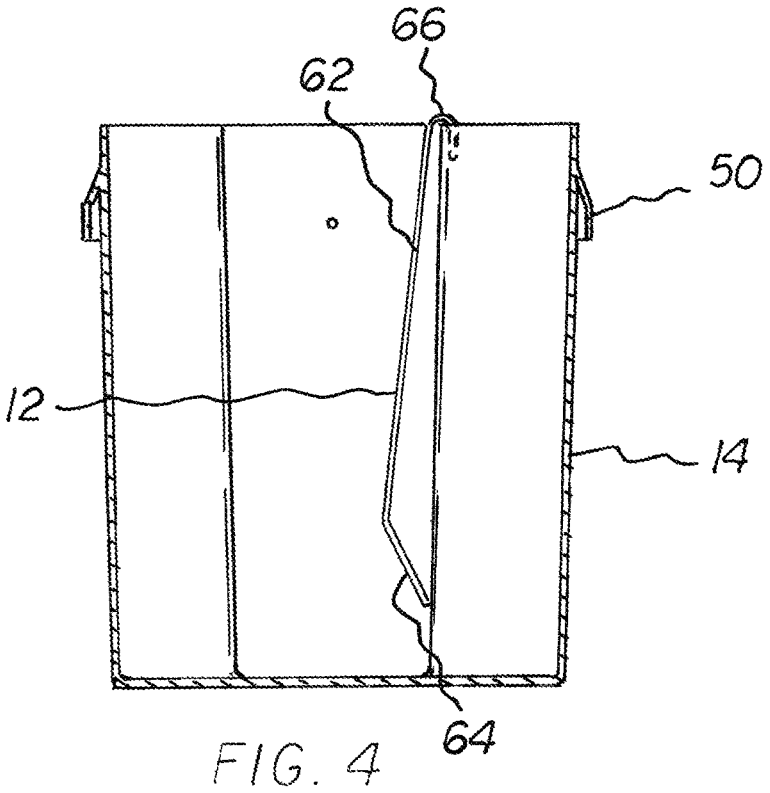
FIG. 4 is a cross sectional view taken along line 4-4 of FIG. 2.
Figure 5:
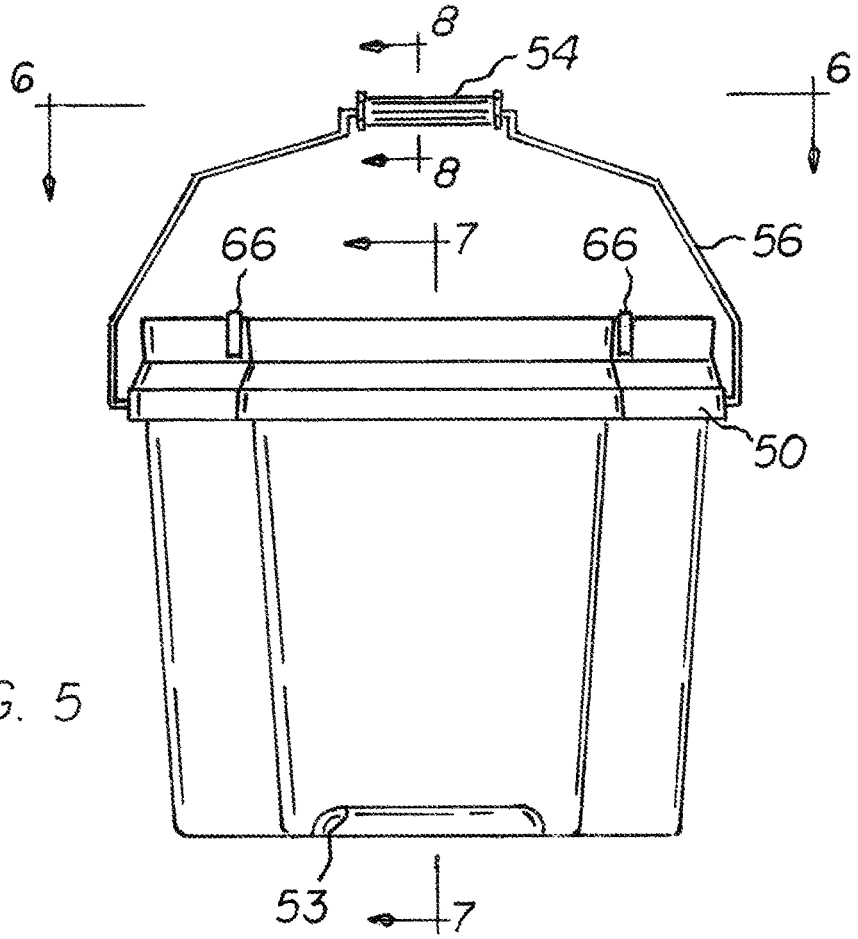
FIG. 5 is a rear elevational view of the system similar to FIG. 2.
Figure 6:
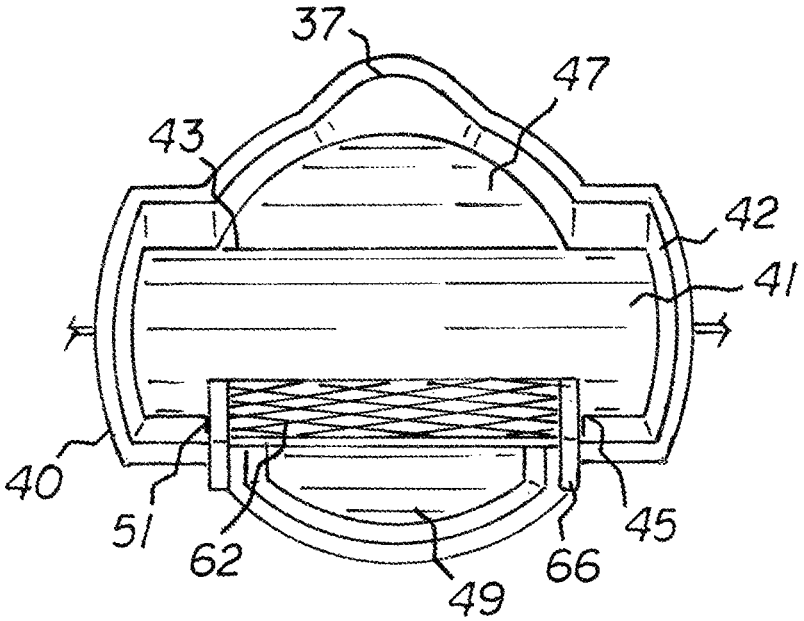
FIG. 6 is a plan view taken along line 6-6 of FIG. 5.

With reference now to the drawings, and in particular to FIG. 1 thereof, the preferred embodiment of the new and improved wide-body roller painting system embodying the principles and concepts of the present invention and generally designated by the reference numeral 10 will be described.

The present invention, the wide-body roller painting system 10, is comprised of a plurality of components. Such components are individually configured and correlated with respect to each other so as to attain the desired objective. In their broadest context such include a bucket with a closed bottom and a side wall having a first major section, a second major section, a first minor section, a second minor section.

In the preferred embodiment of the wide-body roller painting system, designated by reference numeral 10, first provided is a bucket 14. The bucket has a generally cylindrical configuration with an open top 20, a closed bottom 22, and a side wall 24 extending elevationally there between. The bucket has a central axis 26.

The side wall has a first major section 30 extending elevationally between the open top and the closed bottom. The first major section has a lower end 31 adjacent to the closed bottom. The side wall has a second major section 32 extending elevationally between the open top and the closed bottom. The second major section has a lower end 33 adjacent to the closed bottom. The first and second major sections each extend circumferentially for 120 degrees, plus or minus 10 percent. The first and second major sections are circumferentially separated to create a first opening 34 circumferentially and a second opening 36 circumferentially. The first and second major sections are radially spaced from the central axis of the bucket by primary radial distances. The first major section has an outwardly extending V-shaped projection 37 adjacent to the open top.

The side wall has a first minor section 40 and a second minor section 42. The first minor section is located adjacent to the first opening. The second minor section is located adjacent to the second opening. The first and second minor sections each extend circumferentially for 60 degrees, plus or minus 10 percent. The first and second minor sections are spaced from the central axis of the bucket by secondary distances which are greater than the primary distances. The side wall has first parallel extents 44 coupling the first minor section to the first and second major sections adjacent to the first opening. The side wall has second parallel extents 46 coupling the second minor section to the first and second major sections adjacent to the second opening.

The closed bottom is configured with a U-shaped trough 41 essentially extending between the minor sections. The trough has a forward linear edge 43 and a rearward linear edge 45. The closed bottom has forward slope 47 and a rearward slope 49. The forward slope couples the lower end of the second major section to the forward linear edge of the trough. The rearward slope couples the lower end of the first major section to the rearward linear edge of the trough. The forward and rearward slopes form obtuse angles with the second and first major sections respectively. In this manner the forward and rearward slopes direct paint into the trough as paint volume within the bucket decreases during use. The rearward linear edge has a linear recess 51 which extends between the first and second minor sections adjacent to the first major section.

The first major section has a rearward recess 53 centrally positioned adjacent to the closed bottom. The rearward recess provides a gripping area 55 below the rearward slope for enhancing user control while handling the bucket.

The side wall has a collar 50 in an annular configuration integrally fabricated with the side wall adjacent to the open top for strengthening purposes. The bucket, including the side wall and the collar, are fabricated of a generally rigid polymeric material chosen from the class of generally rigid polymeric materials including polyethylene, polycarbonate, and other similar plastic materials.

Provided next is a handle 54 adapted to be gripped by a user for handling the bucket. The handle has an outer cylindrical body 65 and an inner cylindrical body 57. A plurality of Y-shaped ribs 59 extend radially outward along the length of the inner cylindrical body. The ribs are adapted to integrally couple the inner and outer cylindrical bodies. Each of the ribs has a thickness between 1.25 mm and 1.75 mm, plus or minus 10 percent. The handle is fabricated of a generally elastomeric material chosen from the class of elastomeric materials including rubber, silicone, and other similar rubber-like materials. The thickness and material of the ribs allows for flexibility of the outer cylindrical body when a user handles heavy loads such as 5 gallons of paint within the bucket.

A rigid wire 56 is provided next. The rigid wire couples the handle to the collar adjacent to a central extent of the minor sections.

Further provided is a lid 58. The lid has a periphery corresponding in size and shape to the open top of the bucket to which it is removably coupled.

During use, the roller screen 12 is positioned within the bucket. The roller screen has a large upper extent 62 and a small lower extent 64 with an obtuse angle between the upper and lower extents. The upper extent has upper hooks 66 removably positioned on the open top of the bucket spanning the first major section. In this manner the lower extent is removably positioned within the linear recess of the trough for preventing lateral movement of the roller screen.

Lastly the roller 16 has a cylindrical sleeve 72 for painting a surface. The roller has a grip 74 for moving the cylindrical sleeve across the screen to roll off excess paint. The first and second minor sections provide a wider area to effectively roll off excess paint without making unintended contact between the roller and the side wall.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wide-body roller painting system (10) for fixedly positioning a roller screen (12) in a bucket (14) and for abating interference contact between a roller (16) and the bucket, the system comprising, in combination:

the bucket (14) having a generally cylindrical configuration with an open top (20) and a closed bottom (22) and a side wall (24) extending elevationally there between, the bucket having an interior surface and an exterior surface and a central axis (26);

the side wall (24) having a first major section (30) extending elevationally between the open top and the closed bottom, the first major section having a lower end (31) adjacent to the closed bottom, the side wall having a second major section (32) extending elevationally between the open top and the closed bottom, the second major section having a lower end (33) adjacent to the closed bottom, the first and second major sections each extending circumferentially for 120 degrees, plus or minus 10 percent, the first and second major sections being circumferentially separated to create a first opening (34) circumferentially and a second opening (36) circumferentially, the first and second major sections being radially spaced from the central axis by primary radial distances, the first major section having an outwardly extending V-shaped projection (37) adjacent to the open top;

the side wall having a first minor section (40) and a second minor section (42), the first minor section being located adjacent to the first opening, the second minor section being located adjacent to the second opening, the first and second minor sections each extending circumferentially for 60 degrees, plus or minus 10 percent, the first and second minor sections being spaced from the central axis by secondary distances greater than the primary distances, the side wall having first parallel extents (44) coupling the first minor section to the first and second major sections adjacent to the first opening, the side wall having second parallel extents (46) coupling the second minor section to the first and second major sections adjacent to the second opening;

the closed bottom configured with a U-shaped trough (41) essentially extending between the minor sections, the trough having a forward linear edge (43) and a rearward linear edge (45), a forward slope (47) coupling the lower end of the second major section to the forward linear edge of the trough, a rearward slope (49) coupling the lower end of the first major section to the rearward linear edge of the trough, the forward and rearward slopes forming obtuse angles with the second and first major sections respectively, the rearward linear edge having a linear recess (51) extending between the first and second minor sections adjacent to the first major section;

the first major section having a rearward recess (53) centrally positioned adjacent to the closed bottom, the rearward recess providing a gripping area (55) below the rearward slope for a user;

the side wall having a collar (50) in an annular configuration integrally fabricated with the side wall adjacent to the open top for strengthening purposes, the bucket including the side wall and the collar being fabricated of a generally rigid polymeric material chosen from the class of generally rigid polymeric materials including polyethylene, polycarbonate, and other similar plastic materials;

a rigid wire (56) having opposed ends pivotably coupled to the exterior surface of the bucket at central extents of the minor sections;

a lid (58) having a periphery corresponding in size and shape to the open top of the bucket; and the screen (12) at least a majority of which being positioned within the bucket during use, the screen having a large upper extent (62) and a small lower extent (64) with an obtuse angle between the upper and lower extents, the upper extent having upper hooks (66) removably positioned on linear upper edges of the minor sections of the open top of the bucket spanning the first major section, whereby the lower extent is positioned in the linear recess of the trough for holding the screen in place while moving the roller (16) across the screen to roll off excess paint without making unintended contact between the roller and the side wall.

* * * * *